US005937630A

United States Patent [19]

Wassenhoven

[11] Patent Number: 5,937,630

[45] Date of Patent: Aug. 17, 1999

[54] OPEN-END SPINNING DEVICE

[75] Inventor: Heinz-Georg Wassenhoven, Mönchengladbach, Germany

[73] Assignee: W. Schlafhorst AG & Co., Moenchengladbach, Germany

[21] Appl. No.: 08/315,002

[22] Filed: Sep. 29, 1994

[30] Foreign Application Priority Data

Oct. 9, 1993 [DE] Germany ..... 43 34 485

[51] Int. Cl.[6] ..... D01H 4/00

[52] U.S. Cl. ..... 57/407; 57/413

[58] Field of Search ..... 57/407, 413, 417

[56] References Cited

U.S. PATENT DOCUMENTS

| | | | |
|---|---|---|---|
| 3,668,854 | 6/1972 | Le Chatelier | 57/407 |
| 3,785,138 | 1/1974 | Rajnoha et al. | 57/417 X |
| 3,845,612 | 11/1974 | Chisholm et al. | 57/417 X |
| 3,903,683 | 9/1975 | Shino | 57/417 |
| 3,927,516 | 12/1975 | Stahlecker | 57/407 |
| 4,291,528 | 9/1981 | Miyamoto et al. | 57/413 X |
| 4,471,608 | 9/1984 | Kawabata et al. | 57/413 |
| 4,879,873 | 11/1989 | Kawabata et al. | 57/413 |

FOREIGN PATENT DOCUMENTS

| | | | |
|---|---|---|---|
| 21 30 582 | 1/1976 | Germany . | |
| 78 20 853 | 12/1978 | Germany . | |
| 37 05 479 | 1/1988 | Germany . | |
| 36 36 182 A1 | 4/1988 | Germany . | |
| 503127 | 3/1971 | Switzerland | 57/417 |
| 590 346 | 8/1977 | Switzerland . | |

*Primary Examiner*—William Stryjewski

*Attorney, Agent, or Firm*—Kennedy Covington Lobdell & Hickman, LLP

[57] ABSTRACT

The invention relates to an open-end spinning device with a rotor housing connected to a source of suction and open at a front side, in which a rotor rotates at relatively high rpm. A cover element is provided for closing the rotor housing and a cover extension is affixed to the cover element as an exchangeable, dynamically balanced component. The cover extension is releasably disposed in a receptacle recessed in the cover element by means of mating inclined seating surfaces and by axially acting fasteners, and is exactly fixed in position inside this receptacle by an alignment pin engaged in aligned bores in the cover element and in the cover extension.

7 Claims, 2 Drawing Sheets

OPEN-END SPINNING DEVICE

FIELD OF THE INVENTION

The present invention relates to an open-end spinning device with a rotor housing connected to a suction source and open at a front side, a spinning rotor rotatably supported within the housing for driven rotation at relatively high speed and a cover element for closing the open front of the rotor housing, and relates more particularly to the provision of the cover element with a replaceable extension containing an orifice to a fiber guide conduit and a yarn draw-off nozzle.

BACKGROUND OF THE INVENTION

Open-end spinning devices of the indicated construction are known, for example, from German Patent Publication DE 36 36 182 A1.

With a spinning device of this type the rotor housing, which is open at its front, is closed in an airtight manner during the spinning process by a cover element fastened on a pivot housing of the spinning device. The cover element is screwed onto the pivot housing from the inside. In addition, a sliver opening device with a sliver drawing-in cylinder, an opening cylinder and a portion of a fiber guide conduit are arranged in the pivot housing. The rotating parts are arranged such that they are taken out of operation or slowed when the cover element of the spinning device is opened.

The cover element has a circular lip seal which rests against the rotor housing and seals it in an airtight manner during operation, i.e. when the pivot housing is pivoted closed and locked. In this case, an extension of the cover element extends into the rotating rotor and, among other things, contains the orifice of the fiber guide conduit. In this manner, the orifice of the fiber guide conduit is positioned sufficiently close to the fiber slide wall of the spinning rotor that the individual fibers delivered through the fiber conduit are correctly fed to the spinning rotor.

As can be seen, for example, in German Patent Publication DE 37 05 479 A1, the cover elements, which may also be identified as fiber conduit plates, have an exterior annular groove for a lip element as well as a central cover extension. Besides the orifice of the fiber guide conduit, a threaded bore is also formed in the cover extension for fastening a fiber draw-off nozzle. Although these cover elements have proven satisfactory in actual use, they are generally made in the form of injection molded parts and therefore are relatively expensive to produce.

Since these cover elements (or fiber conduit plates), particularly the cover extensions, must correspond to defined rotor diameters, it is necessary to also exchange the cover elements when an exchange of the spinning rotors becomes necessary, e.g., in the course of a change of a yarn batch.

Various attempts have been made in the past to increase the range of rotor sizes with which such cover elements may be employed or to simplify their structural design. However, the devices known so far have not succeeded in actual use.

For example, it is known from German Patent Publication GM 78 20 853 to employ an adapter which can be placed on the cover extension when needed. In this way it is intended to make it possible to maintain the required spinning geometries, in particular the distance between the orifice of the fiber guide conduit and the fiber slide wall surface of the rotor, even when a change to a larger spinning rotor is made.

Furthermore, it is known from German Patent Publication DE AS 21 30 582 to close the rotor housing by means of a cover element which has a centered recess for receiving a cylindrical, piston-like insertion element. This insertion element, which contains the orifice of a fiber guide conduit as well as a central yarn withdrawal conduit, is maintained inside this recess by a radially acting clamping screw. However, the structural design of this cylindrical insertion element is not suited to assure the dependable sealing of the rotor housing.

SUMMARY OF THE INVENTION

Proceeding from the above mentioned prior art, it is accordingly an object of the present invention to provide a cover for a rotor housing in an open-end spinning device which can be manufactured in a cost-effective manner and is dependable in operation.

Briefly summarized, the present invention accomplishes the foregoing objective in an open-end spinning device comprising a rotor housing connected to a suction source and having an open front, a spinning rotor disposed rotatably within the rotor housing, a cover element for selectively closing and opening the open front of the rotor housing, the cover element defining a guide conduit for delivering fiber into the spinning rotor, and a cover extension replaceably mounted to the cover element along an installation and withdrawal path, the cover extension defining a fiber outlet opening communicating with the fiber guide conduit and the cover extension supporting a yarn draw-off nozzle. According to the present invention, the cover element includes a receptacle for receiving the cover extension and the cover extension has a surface at least in the area of communication between the fiber guide conduit of the cover element and the outlet opening of the cover extension for seating the cover extension with the receptacle of the cover element. The seating surface of the cover extension is disposed at an inclination in relation to the installation and withdrawal path for the cover extension, and fastening means act in the direction of the installation and withdrawal path for fixing and positioning the cover extension releaseably relative to the receptacle of the cover element.

By the provision of axially acting fastening means, the inclined seating surface of the cover extension provides the advantage of assuring an airtight closure of the fiber conduit portions in the transition area of the fiber conduit between the cover element and outlet opening of the cover extension. The releasable arrangement of the cover extension inside the receptacle of the cover element offers the further advantage that, in case of a yarn batch change or the like, it is only necessary to change the cover extension and not the entire cover element.

In a preferred embodiment, a cylindrical pin is utilized for fitting the cover extension on the cover element by insertion into a fitting bore in the cover element and engagement in a corresponding fitting bore of the cover extension, thereby assuring a functionally correct installed position of the cover extension. Because of this exact, angularly correct alignment of the cover extension, it is assured that no projections which could hamper fiber transport occur inside the fiber guide conduit, particularly at the transition point from the cover element to the cover extension.

According to a further aspect of the invention, the cover extension is embodied as a dynamically balanced component with a rearward, conical seating surface. Such an embodiment is very advantageous, in particular in respect to production techniques. However, it is also possible to produce the cover extension as a component in the form of a truncated pyramid. In such case, the cover extension has flat seating surfaces.

The cover extension is fastened within the receptacle of the cover element by threaded screws or other suitable fastening means extending through the cover element from exteriorly thereof to draw the corresponding seating surfaces of the cover element and the cover extension in the area of the fiber guide conduit and the outlet opening together, which advantageously results in airtight seating.

The cover extension has a central through-bore for receiving a yarn draw-off nozzle. An angularly disposed threaded bore terminates in this through-bore and receives a threaded pin for fastening the yarn draw-off nozzle. In an extension of this threaded bore an access opening is preferably provided in the area of the cover element, which allows a suitable tool, such as a screwdriver, access to the threaded pin, whereby it is possible to change the yarn draw-off nozzle even while the cover extension is still installed.

DETAILED DESCRIPTION OF THE PREFERRED EMBODIMENT

Figure 1:
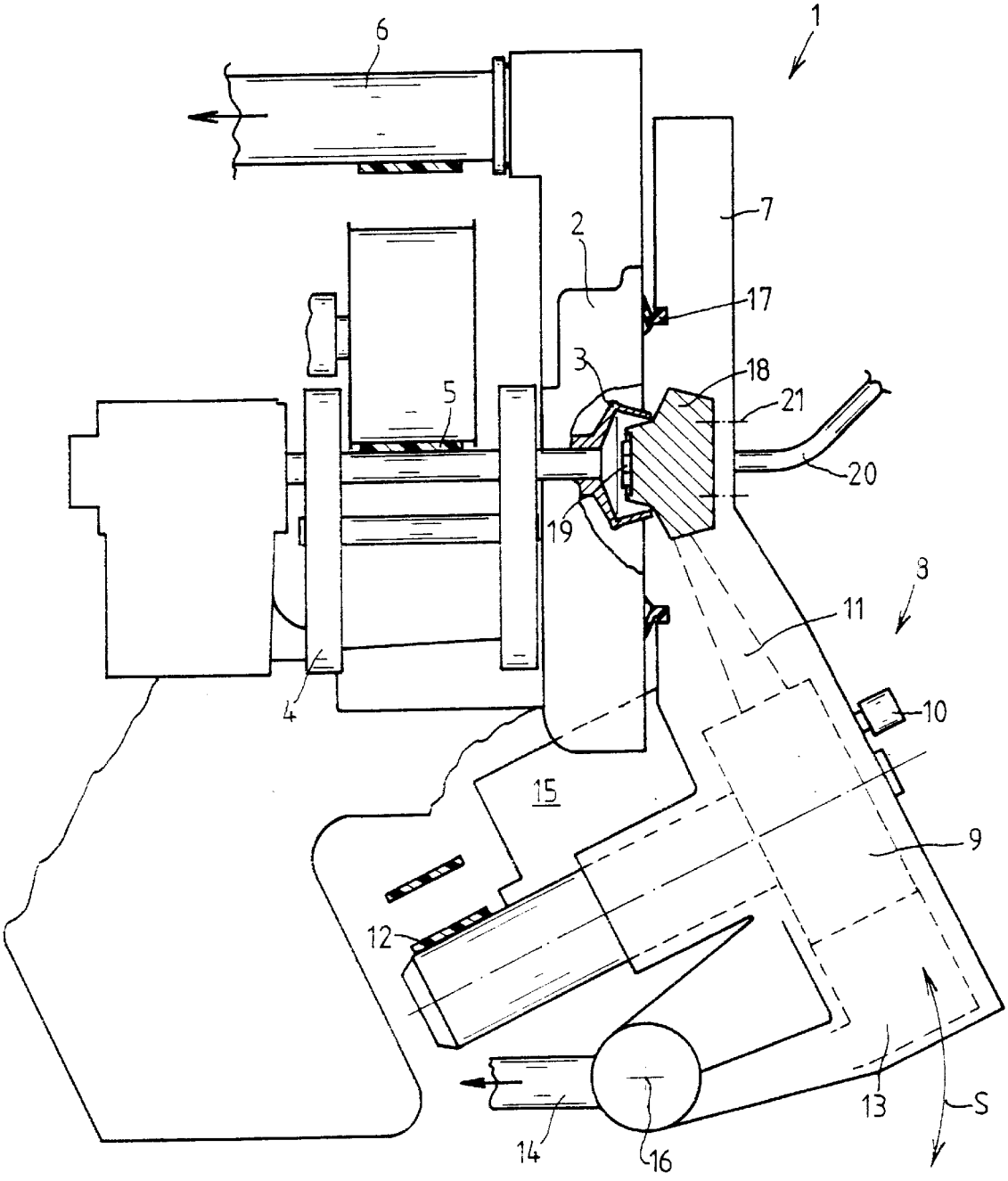
FIG. 1 is a side elevation of an open-end spinning device equipped with a cover element closing off the rotor housing, as well as with a releasably fastened cover extension, in accordance with one preferred embodiment of the present invention.

As is conventional, the open-end spinning device 1 illustrated in FIG. 1 has a rotor housing 2 in which a spinning rotor 3 is rotatably supported for driven rotation at relatively high rpm. In this case, the spinning rotor 3 is supported by a support disk bearing 4 and is driven by a tangential drive belt 5.

The rotor housing 2 is open at its front side and is connected to a suitable source of suction by a connecting conduit 6. During spinning operation, the housing 2 is closed at the front side by a cover element 7 which is pivotably supported on a pivot shaft 16. The cover element 7 carries a sliver opening device 8 having an opening cylinder 9, a sliver drawing-in cylinder 10 (not shown in detail) and a portion of the fiber guide conduit 11. The opening cylinder 9 is preferably driven by a tangential belt 12. The drive of the sliver drawing-in cylinder 10 is provided either by a drive shaft extending the length of the spinning machine or via an individual electrical drive 15. A debris collection chamber 13, which is continuously emptied via a debris suction device 14, is also located in the cover element 7 beneath the opening cylinder 9.

The cover element 7 has an annular groove 32 for the insertion of a lip sealing element 17 as well as a receptacle 33 defined by conical seating surfaces 34 recessed into the forward face of the cover element 7 to open in the direction toward the rotor housing 2. A cover extension 18 is fixed in the receptacle 33 by means of threaded screw bolts 21 which extend through corresponding throughbores in the cover element 7 to engage threaded fastening bores 30 of the cover extension 18. The exact disposition and orientation of the cover extension 18 within the receptacle 33, in particular the precise desired angular alignment of the cover extension, is accomplished by means of a cylindrical pin 26 which is inserted into a fitting bore 35 of the cover element 7 and engages a corresponding aligned fitting bore 25 on the rearward side 36 of the cover extension 18. In the assembled state the cover extension 18, which has been aligned in an exact angular position by means of the cylinder pin 26, rests with its conical seating surface 31 on the correspondingly formed seating surface 34 of the receptacle 33 and is secured in such disposition by the axial engagement of the fastening bolts 21 in the bores 30.

The cover extension 18 additionally has a central through-bore 24 opening from its forward side to receive a yarn withdrawal nozzle 19, and at its rearward side 36 to communicate with yarn draw-off tube 20. A threaded bore 27 extends at an angle through the cover extension 18 and terminates in this through-bore 27 to receive a threaded pin or set screw 28 which fixes the yarn draw-off nozzle 19 in the through-bore 24. A connecting bore or other access opening (not shown) is formed in the cover element 7 as an extension of the threaded bore 27 to allow a tool access to the threaded pin 28 engaged in the threaded bore 27. Because the threaded pin 28 is thereby accessible from the exterior of the cover element 7, it is possible to change the yarn draw-off nozzle 19 with the cover extension 18 remaining installed in the cover element 7.

Figure 3:
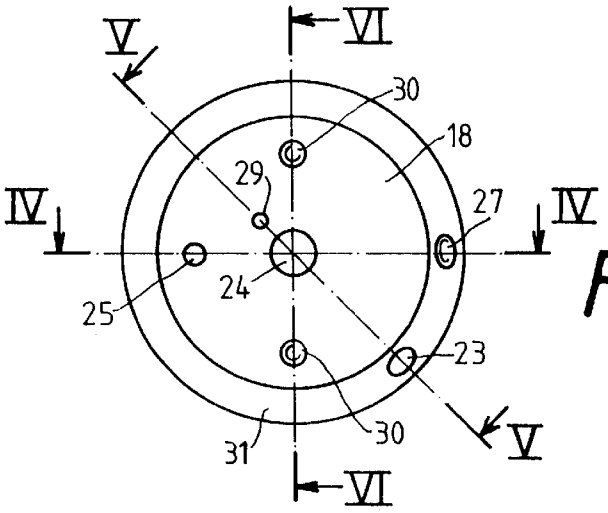
FIG. 3 is a rear elevation of the cover extension of the device of FIG. 1.
Figures 4, 5, 6:
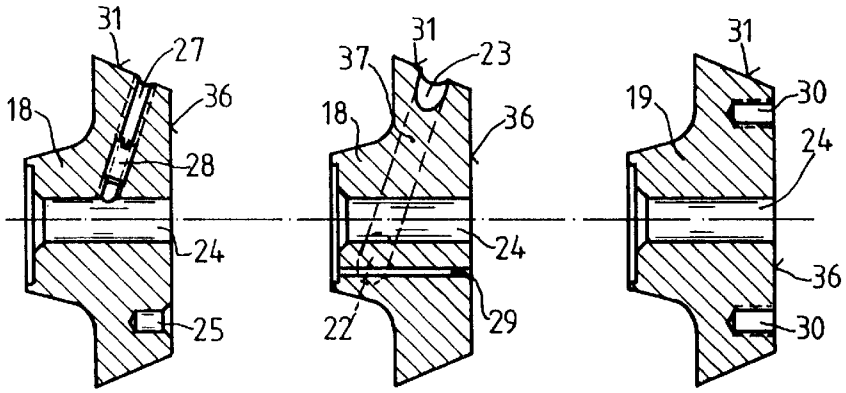
FIG. 4 is an axial cross-section of the cover extension taken along the section line IV—IV of FIG. 3.
FIG. 5 is another axial cross-section of the cover extension taken along the section line V—V of FIG. 3.
FIG. 6 is another axial cross-section of the cover extension taken along the section line VI—VI of FIG. 3.
Figure 2:
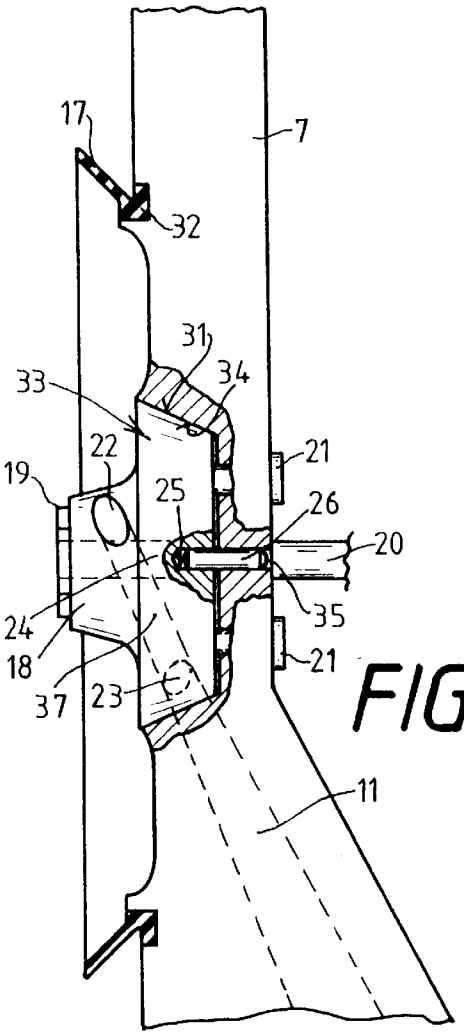
FIG. 2 is a side elevation, partially broken away, of the cover element of the device of FIG. 1 on an enlarged scale.

It can be seen in particular by means of FIGS. 3 to 5 that the threaded bore 27 as well as the fiber guide conduit section 37, which forms a fiber outlet opening 22 communicating with the fiber guide conduit 11 at transition point 23, are formed orthogonally or nearly orthogonally into the conical seating surface 31 of the cover extension 18.

As will thus be understood, the cover element of the present invention, in particular the provision of inclined seating surfaces for the cover extension and axially acting fastening means together with the provision of an appropriate fitting means for the cover extension, constitute an improvement of the rotor housing covers known heretofore. In this manner, the present invention offers advantages in respect to cost-effective production as well as its dependable operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An open-end spinning device comprising:

(a) a rotor housing connected to a suction source and having an open front;

(b) a spinning rotor disposed rotatably within the rotor housing;

(c) a cover element for selectively closing and opening the open front of the rotor housing, the cover element defining a guide conduit for delivering fiber into the spinning rotor;

(d) a cover extension replaceably mounted to the cover element along an installation and withdrawal path, the cover extension defining a fiber outlet opening communicating with the fiber guide conduit;

(e) a yarn draw-off nozzle attachable to the cover extension, the cover element including a receptacle for receiving the cover extension with the cover extension having a surface at least in the area of communication between the fiber guide conduit of the cover element and the outlet opening of the cover extension configured to mate with the receptacle for seating the cover extension with the receptacle of the cover element, the seating surface of the cover extension being disposed at an inclination in relation to the installation and withdrawal path for the cover extension; and (f) fastening means acting in the direction of the installation and withdrawal path for fixing and positioning the cover extension releasably relative to the receptacle of the cover element.

2. An open-end spinning device in accordance with claim 1, wherein the fastening means comprises aligned fitting bores in the cover element and in the cover extension and a cylinder pin disposed in the fitting bores.

3. An open-end spinning device in accordance with claim 1, wherein the seating surface of the cover extension comprises a conical rearward surface of the cover extension, the receptacle of the cover element comprising a correspondingly conical seating surface.

4. An open-end spinning device in accordance with claim 3, wherein the cover extension comprises a truncated conical body having an annular periphery forming the seating surface and the receptacle of the cover element comprises a correspondingly formed truncated conical seating surface.

5. An open-end spinning device in accordance with claim 1, wherein the fastening means comprises at least one threaded bore on a rearward surface of the cover extension and a threaded fastener for engagement in the threaded bore.

6. An open-end spinning device in accordance with claim 1, wherein the cover extension has a central through-bore for receiving the yarn withdrawal nozzle, a threaded bore extending angularly to the through-bore, and a threaded fastener in the threaded bore for securing the yarn withdrawal nozzle.

7. An open-end spinning device in accordance with claim 6, wherein the threaded bore is disposed orthogonally with respect to the seating surface.

* * * * *